United States Patent [19]

Wasserman et al.

[11] Patent Number: 4,764,391

[45] Date of Patent: Aug. 16, 1988

[54] PROCESS FOR PREPARING AND STORING BREWED BEVERAGES

[75] Inventors: Gerald S. Wasserman, East Brunswick; Karl C. Kramer, Dunellen; Slawko Yadlowsky, Manville, all of N.J.

[73] Assignee: General Foods Corporation, White Plains, N.Y.

[21] Appl. No.: 120,676

[22] Filed: Nov. 12, 1987

Related U.S. Application Data

[63] Continuation of Ser. No. 849,651, Apr. 9, 1986, abandoned.

[51] Int. Cl.[4] ..... A23F 5/26

[52] U.S. Cl. ..... 426/433; 99/306; 99/279; 220/93; 426/418

[58] Field of Search ..... 99/279, 275, 295, 306; 220/93; 426/665, 433, 418

[56] References Cited

U.S. PATENT DOCUMENTS 1,990,918 2/1935 Ramsden ..... 222/491
2,726,012 12/1955 Jensen ..... 220/93
3,974,758 8/1976 Stone, Jr. ..... 99/275
3,987,941 10/1976 Blessing ..... 222/386

FOREIGN PATENT DOCUMENTS 0110617 6/1984 European Pat. Off. .

OTHER PUBLICATIONS

Sivitz, Coffee Processing Technology, vol. 1, Avi Publishing, 1963, pp. 347–348.

Sivetz, Coffee Processing Technology, 1963, vol. I, Avi: Westport, Conn., pp. 347–348.

*Primary Examiner*—Joseph Golian

*Attorney, Agent, or Firm*—Thomas R. Savoie; D. J. Donovan

[57] ABSTRACT

A floating lid is provided which enables the preparation of a beverage of uniform consistency which is retarded in its loss of volatile, oxidation and contamination. The floating lid is buoyant and has an aperture through which the beverage passes. The aperture is surrounded by upwardly-extending walls which form a chamber for the purpose of creating a hydrostatic head of beverage above the aperture.

4 Claims, 1 Drawing Sheet

FIG.1
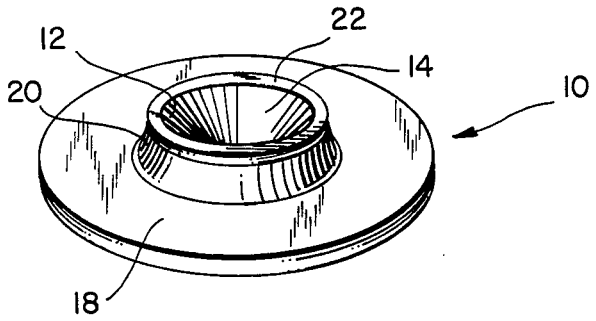
FIG.2
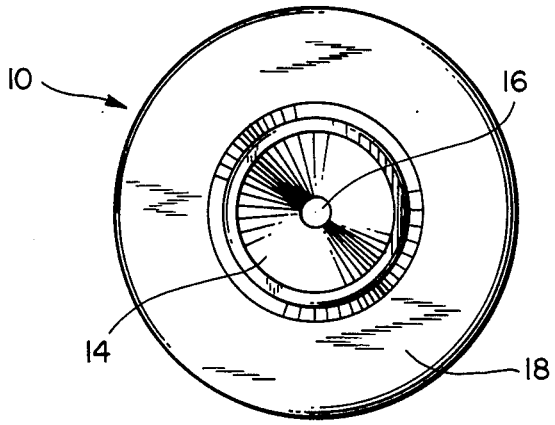
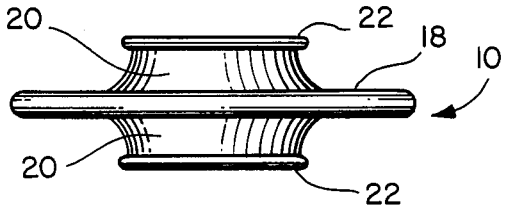
FIG.3

PROCESS FOR PREPARING AND STORING BREWED BEVERAGES

This application is a continuation of application Ser. No. 849,651, filed 4/9/86, abandoned.

TECHNICAL FIELD

The invention relates to a floating lid for use in conjunction with a container for collecting and dispensing beverages. More particularly, the invention relates to a floating lid with a brewing feature for the preparation of a homogeneous beverage.

BACKGROUND OF THE INVENTION

The preparation, storage and service of such beverages as hot chocolate, coffee and tea or of such foods as bouillons and soups, present unique logistical problems which render most available vessels inadequate for the above-stated purposes. Such well known containers as the ubiquitous coffee pot, or urns of traditional design can be efficiently employed to heat and serve a pourable comestible. The most significant problems are encountered when the above-mentioned containers are used to maintain such products for prolonged periods of time. For example, coffee which is stored in traditional covered containers, oxidizes upon exposure to and interaction with the surrounding air. This interaction gives rise to off-flavors, rendering the product unacceptable to consumer tastes. Loss of aromatic and desirable volatiles from the exposed surface of the liquid is also a detrimental factor. As the void between the upper level of the comestible and any stationary cover increases, the potential for exposure to outside atmospheric contamination increases as does the potential for the loss of endogenous volatiles.

The problem of oxidation of and loss of volatiles from flowable foodstuffs which must be kept in a heated condition for extended periods of time is well-known in the art. In fact, there are several prior art references which disclose specific embodiments for enclosing a liquid foodstuff beneath a sealing member to prevent oxidation or contamination. U.S. Pat. No. 551,540 discloses such an appliance that has a floating lid which seals liquid within a container. U.S. Pat. No. 1,948,353 shows a similar article, as does U.S. Pat. No. 3,804,635.

U.S. Pat. No. 1,990,918 to Ramsden discloses a serving pitcher containing parallel walls and a float adapted to rest upon and substantially cover the liquid surface within the pitcher. The Ramsden float was taught to fit within the pitcher "sufficiently closely to exclude practically all the air" and was intended to prevent the formation of skin or scum on milk after heating or boiling. Ramsden also discloses the possibility of placing an aperture in the float to enable insertion of a stirring rod into the liquid.

U.S. Pat. No. 3,987,941 issued to Blessing, discloses a container for preserving liquids or other liquid food products wherein a cylindrical container is fitted with a follower lid which is supported by the upper level of the liquid and descends downward as the contents of the container are dispensed via a spigot located thereinbelow. This reference discloses a lid which adaptively employs a flexible seal, said seal being attached to the perimeter of the round lid so that an essentially air tight relationship relative to the liquid food product results. The lid is of a diameter which at least equals the inside diameter of the vessel in Blessings design. Moreover, the above-cited design must be incorporated into a non-pourable, static "urn-type" dispensing appliance. Under these design constraints the contents can never be poured from the container, for the lid would tumble out of the container. A spigot located along the bottom well of the tank is the sole egress means for removing the heated beverage from the reservoir. In fact, the lid is weighted so that its center of gravity is as low as possible and is located at the center point of the lid; it is designed so that its travel path is restricted to an upward and downward movement making it impossible to tilt the appliance and the lid to thereby effect pouring.

U.S. Pat. No. 3,974,758 to Stone discloses the use of a sealed or unsealed follower lid in a straight-walled, pour-type coffee maker. This patent further discloses the use of a coventional pour spout of relatively small cross-sectional area whereby coffee from the bottom of the coffee maker is poured from the spout or the use of a pour lip at the upper end of the coffee maker whereby coffee is removed from the top of the coffee maker.

Published European patent application No. 110,617 to Spotholz et al. discloses a floatingly retained, insulation lid which tracks the level of a beverage contained in a vessel and prevents oxidation, loss of volatiles, and contamination of said beverage.

It has been found that the prior art systems do not permit preparation of a homogeneous beverage of uniform consistency with a floating lid in place within a vessel.

It is an object of the present invention to provide a lid for use in a vessel which is employed to receive and dispense liquids, said lid permitting preparation of a homogeneous beverage of uniform consistency.

It is a further object that the lid prevent oxidation, loss of volatiles and contamination of the beverage contained in the vessel.

SUMMARY OF THE INVENTION

It has now been found that the objects of the invention are met by a floating lid which may be used in conjunction with vessels into which liquids are added, as for example brewed, and from which liquids are dispensed, as by pouring. The floating lid has an aperture located substantially at its center which provides a conduit for liquids to pass from above the lid to below the lid. In order to produce a beverage of uniform consistency, particularly in instances where the beverage is an infusion as for example a coffee or tea infusion, it has been found that said aperture must be critically sized such that a sufficient liquid head is developed above said aperture. It has been found that floating lids which have apertures which restrict liquid flow to the extent necessary to create the desired head are effective in preparing a beverage of uniform consistency. Moreover, said floating lid is effective to retard the oxidation, volatile loss, and contamination of said beverages.

BRIEF DESCRIPTION OF THE FIGURES

FIG. 1 is a perspective view of a floating lid with a brew feature.

FIG. 2 is a top view of a floating lid with a brew feature.

FIG. 3 is a side view of a floating lid with a brew feature.

DETAILED DESCRIPTION OF THE INVENTION

The floating lid of the present invention may be employed with any liquid comestible which is desirably fed into a vessel and dispensed therefrom. Liquid comestibles which are prepared by infusion, as for example a roasted coffee or tea brew, are particularly suitable for the invention. Though the invention is applicable to many liquid comestible systems, for convenience the discussion which follow will be directed primarily to roasted and ground coffee brews. This is merely intended for ease of description and is not intended to limit the invention to use in the preparation of coffee brews.

The floating lid of the invention is typically employed in a vessel having straight walls or walls which are substantially straight. The floating lid is generally placed within the vessel prior to introducing a beverage thereto. Thus, in a typical application, the floating lid will be contained within a vessel having substantially straight walls and generally said lid will rest at or near the bottom of said vessel. The floating lid may be maintained near but above the bottom of the vessel by supporting protrusions which extend from the side walls of the vessel near said vessel bottom. Supporting protrusions may be found to be desirable in an application where the vessel is to be maintained on a heated surface, as for example a hot plate, so as to prevent heat damage to the floating lid which could result if the lid rested directly on the bottom of the vessel.

The design of the floating lid is such that it fits within the substantially straight walled vessel in which it is to be placed. In a typical embodiment of the invention, the straight walled vessel is essentially cylindrical in design with a pour spout located at the top. In such an embodiment, the floating lid of the invention is circular in shape with a diameter which is slightly smaller than the straight walled vessel's diameter. That is to say that the floating lid diameter is sized such that a clearance exists between the cylindrical inner wall of the vessel and the outer edge of the circular floating lid. It is desired that said clearance be minimal so that the floating lid is able to cover substantially the entire surface of a beverage contained within said vessel. Thus, in a typical embodiment, the diameter of the floating lid is at least 90% of the inner diameter of the cylindrical vessel, and preferably at least 95% of said inner diameter.

In preparing a roasted and ground coffee brew, typically an amount of roasted and ground coffee is placed in a brew basket, generally on filter paper, and heated water is added thereto. The heated water extracts soluble coffee solids from the roasted and ground coffee, exits the brew basket and flows into a suitable collection vessel. It is generally recognized that a concentration profile results when roasted and ground coffee is extracted via percolation, as graphically illustrated by Sivitz and Foote, *Coffee Processing Technology,* Vol. 1, Avi Publishing Co., 1963, p. 348, FIG. 145, and accompanying text, hereby incorporated by reference. Said concentration profile is characterized in that the initial extract is higher in soluble solids concentration than the extract produced later in the percolation cycle. It is also generally recognized that a comparable result occurs when a coffee brew is prepared in a roasted and ground coffee brewer, with the initial coffee brew exiting the brew basket being higher in coffee solids concentration than the coffee brew generated later in the extraction process. Thus, it has been found to be critical that a sufficient level of turbulence exist within the vessel which receives the coffee brew from the brew basket in order that a brew of uniform soluble coffee solids concentration be produced without an externally applied mixing mechanism.

The floating lid of the present invention has a flow-through feature which allows the lid to be contained within the vessel prior to introduction of a liquid comestible such as coffee extract. Whereas an aperture of sufficient size to permit a liquid comestible to pass directly through without contacting the surface of the lid has been found to generate sufficient turbulence to produce a product of uniform consistency, it has also been found that variabilities in brewer and brew basket designs, beverage flow patterns and operating personnel habits, for example, make it impossible to assure that the liquid comestible will pass directly through the floating lid without making the aperture so large as to negate and sacrifice the desired retardation of beverage oxidation, volatile loss, and contamination. Thus, the floating lid of the present invention has an aperture located at or near its center which is bounded by upwardly extending walls which form a chamber of sufficient size to assure that the liquid comestible will be directed to said aperture. The upwardly extending walls surrounding the aperture form a chamber into which the comestible flows. The cross-sectional area of the chamber at its upper-most point, i.e., where the upwardly extending walls end, is substantially larger than the cross-sectional area of the aperture. In a preferred embodiment, the upwardly extending walls form a conical chamber.

It has been further found that a liquid comestible which enters the chamber above the aperture striking the upwardly extending walls of the chamber may lose the minimum necessary downward velocity to generate sufficient turbulence upon passing through the aperture to produce a comestible of uniform consistency. That is to say, in preparing a roasted and ground coffee brew, for example, an insufficient level of turbulence may result below the floating lid, thereby producing a coffee brew characterized by a higher coffee solids concentration toward the bottom of the vessel and a lower coffee solids concentration at the upper surface of the brew which is covered by the floating lid. Such a striation of coffee solids concentration results in individual coffee preparations of inconsistent concentration when poured from the vessel which is wholly unacceptable. Said unacceptable striation is avoided according to the present invention by sizing said aperture such that a hydrostatic head is formed and maintained above said aperture during the brewing process. Accordingly, the chamber formed by the upwardly extending walls contains a residual level of beverage during the brewing process which acts to increase the velocity of liquid through the aperture, thereby increasing the turbulence below the floating lid. Moreover, the aperture is sufficiently small that the floating lid still acts to retard the oxidation, loss of volatiles, and contamination of said beverage.

The static pressure at the foot of a vertical column of a fluid of uniform density exceeds that at the top as a function of the height and density of the fluid. Said static pressure has been found to translate to an increased turbulence below the floating lid. According to the invention, a residual liquid comestible height within the chamber above the aperture of at least 0.25 inches and preferably at least 0.5 inches has been found to contribute the necessary turbulence. In a typical roasted and ground coffee brewer embodiment wherein the coffee brew time is generally constrained to less than 3 minutes for quality and convenience reasons, a circular aperture having diameter of about 0.125 inches to about 0.25 inches has been found to result in a sufficient head to produce a coffee brew of uniform consistency. For other beverage applications having different preparation time influences and constraints, the rate at which the beverage enters the chamber above the aperture may vary, necessitating an adjustment of the aperture size. However, so long as the aperture is sized so as to be effective to form a head above the aperture corresponding to a fluid height of at least 0.25 inches, a beverage of uniform consistency with a reduced degree of oxidation, volatile loss and contamination will result.

The material of construction for the present invention should be heat resistant and not degrade under repeated exposure to acidic comestibles or high temperatures. The floating lid may be constructed of glass, ceramics, metal or a polymeric material, as for example polypropylene, polyvinyl chloride, polyethylene terephalate, polycarbonate or nylon. Hydrophobic polymers are especially well-suited for the invention because they generally do not degrade upon exposure to high temperature and/or acid or alkaline enviornments.

The floating lid of the invention is designed so as to be buoyant. The buoyancy of said lid enables the lid to adjust to any angle at which the liquid comestible surface is disposed and permits pouring of a comestible from a vessel without interference from the floating lid. Said buoyancy also permits the floating lid to rise upon the comestible surface as the liquid level below the lid increases due to the passage of additional liquid through the aperture in the lid. In a preferred embodiment of the invention, the floating lid is essentially hollow, advantageously employing a buoyancy line and a point of gravity that will, at all times, exert sufficient force downward to retain the floating lid within the upper surface of the beverage.

The floating lid may possess an internal insulation barrier, which aids in maintaining the liquid comestible in a heated condition, if so desired. The insulation within the floating lid acts as a thermal barrier and may be comprised of insulating materials, an air space or a vacuum or a gas. The floating lid may be essentially convex or flat on either or both of its surfaces, i.e., its top and bottom surfaces. The lid may have pointed or rounded edges, or the top and bottom surfaces may meet to form a straight-walled edge. Moreover, the floating lid is preferably constructed such that the top and bottom surfaces of the lid are identical, which is to say that "upwardly extending" walls surround the aperture on both sides of the lid. Thus, in this preferred embodiment, there is not a top and bottom surface but rather two surfaces which may act interchangably.

Turning now to the figures, FIGS. 1 to 3 illustrate a floating lid produced according to the invention, commonly numbered parts being the same for all figures. FIG. 1 is a perspective view of a circular lid 10 having a lid body 18 and upwardly extending walls 12 which form a conical chamber 14. The conical chamber has outer walls 20. The outer walls and upwardly extending walls meet to form a circular lip 22 for ease of handling.

FIG. 2 is a top view of circular lid 10, showing a circular aperture 16 within the conical chamber 14.

FIG. 3 is a side view of lid 10 showing the outer walls 20 of the chamber extending both above and below the lid body 18, thereby forming lips 22 both above and below the lid body.

EXAMPLE 1

Two roasted and ground coffee brews were prepared using a Bunn Brewer at a recipe of 2.25 oz. roasted and ground coffee and 1780 ml. of water. The control brew was held in a vessel without the floating lid of the invention. Sample A was held in a vessel with a floating lid on its surface having an aperture of 0.25 inch diameter surrounded by a conical chamber formed by upwardly extending walls of polypropylene construction. The floating lid body diameter was greater than 90% of the inner diameter of the vessel. The brews were analyzed at zero time and at one hour increments for three hours for brew transmission as detailed below.

MEASUREMENT OF ROASTED AND GROUND COFFEE BREW TRANSMISSION

Instrument: Bausch & Lomb Spectronic 20 Spectrophotometer

1. Instrument is set for 600 millimicron wavelength on the dial provided.
2. Instrument is warmed up for at least 15 minutes.
3. Calibration—With the measuring chamber empty, i.e., no glass tube, the instrument is set at 0, i.e., 0% transmission. Using the test tubes provided, water is added to the tube to the required level and the filled tube inserted into the Measuring Chamber. The reading on the instrument should be 100%, i.e., total transmission. If necessary dial adjustments are made so that this reading is 100%, the instrument is now ready to be used.
4. Brew Measurements—Roasted and ground brew may now be measured by filling the test tubes provided with the brews and placing them in the measuring chamber. Several measurements should be made to insure accuracy. The reading or brew transmission is read directly off the scale that is in the center of the instrument. The higher the number or brew transmission recorded, the weaker or lighter the brew and conversely, the lower the number the darker the brew.

The results of the analyses are summarized in Table I. As can be seen, the control sample had a steady decrease in numerical brew transmission reading which demonstrates a darkening of brew. This darkening corresponds to an undesirable degradation of coffee flavors over time. Sample A, however, maintained a nearly constant brew transmission level over time which demonstrates a preservation of coffee flavor. Organoleptic evaluations showed Sample A to be of better quality over the storage period than the Control.

TABLE I

| | Zero Time | 1 Hour | 2 Hours | 3 Hours |
|---|---|---|---|---|
| Control | 41 | 32 | 29 | 26 |
| Sample A | 43 | 35 | 35 | 34 |

EXAMPLE 2

Roasted and ground coffee brews were prepared in the same Bunn Brewer according to the same recipe level as Example 1 (2.25 oz. R&G coffee/1780 ml. water). The control sample was brewed into a standard glass bowl having a rounded bowl bottom. Variant A was brewed into a straight-walled vessel containing a floating lid with a circular aperture of 0.375 inch diameter surrounded by upwardly extending walls which form a conical chamber. Variant B was brewed into a straight-walled vessel containing a floating lid with a circular aperture of 0.25 inch diameter surrounded by upwardly extending walls which form a conical chamber. A head of about 0.5 inches to about 0.75 inches was observed within the chamber formed by the upwardly extending walls of the floating lid of Variant B whereas no head was observed in the chamber above the 0.375 inch diameter aperture during the brewing of Variant A, this despite the fact that brew entered the chambers at essentially the same rate in each case.

The homogeneity of brew was analyzed according to the following method:

Upon completion of the brew, a single cup is poured with the floating lid in place (for Variants A and B). This sample is termed the "First Cup". The floating lid is then removed and the contents of the vessel are stirred with a spoon. The mixed content of the vessel is termed the "Full Pot" sample.

First Cup and Full Pot samples for the Control, Variant A and Variant B were analyzed according to the Roasted and Ground Coffee Brew Transmission method described in Example 1. The results are summarized in Table II.

TABLE II

| | Brew Transmission Difference Between First Cup and Full Pot | Hydrostatic Head (Inches) |
|---|---|---|
| Control | 3% | — |
| Variant A | 18% | 0 |
| Variant B | 0% | 0.5–0.75 |

The brews for the Control, Variant A and Variant B, had equivalent total brew solids levels. However, the floating lid for Variant B which was effective to produce a hydrostatic head within its chamber of about 0.5 to 0.75 inches produced a homogeneous brew having no brew transmission difference between the first cup and the full pot. The floating lid which was not effective in producing a hydrostatic head in its chamber produced a striated brew having an 18% difference in brew transmission readings.

We claim:

1. In a process for preparing brewed coffee and storing the coffee brew in an essentially straight-walled vessel wherein a buoyant lid is placed within the vessel prior to introducing the coffee brew into the vessel, said coffee brew having a soluble solids concentration profile such that the initial portion of brew which is received within the vessel has a higher concentration than the brew which is later received, and wherein the buoyant lid is sized to cover substantially the entire surface of the coffee brew contained in the vessel, the improvement comprising utilizing a buoyant lid which has an aperture located at or near its center which aperture is surrounded by upwardly extending walls, said walls forming a chamber of sufficient size to assure that the coffee brew introduced to said vessel will be directed to said aperture, and introducing coffee brew into the buoyant lid-containing vessel such that the brew enters the chamber and forms a hydrostatic head above the aperture which head is at least 0.25 inches high and which head is effective to increase turbulence below the lid to a level which will result in the coffee brew in the vessel having a uniform consistency.

2. The method of claim 1 wherein the upwardly-extending walls form a conical chamber.

3. The method of claim 2 wherein the height of the hydrostatic head is at least 0.5 inches.

4. The method of claim 1 wherein the vessel is maintained on a heated surface during storage of the coffee brew.

* * * * *